United States Patent [19]

Salomon

[11] Patent Number: 4,583,757

[45] **Date of Patent: * Apr. 22, 1986**

[54] SAFETY BINDING FOR SKI

[75] Inventor: Georges P. J. Salomon, Annecy, France

[73] Assignee: Salomon S.A., Annecy, France

[ * ] Notice: The portion of the term of this patent subsequent to Jul. 3, 2001 has been disclaimed.

[21] Appl. No.: 606,602

[22] Filed: May 3, 1984

Related U.S. Application Data

[63] Continuation of Ser. No. 376,754, May 10, 1982, Pat. No. 4,457,533, which is a continuation of Ser. No. 106,148, Dec. 21, 1979, abandoned.

[30] Foreign Application Priority Data

Dec. 28, 1978 [FR] France ..... 78 37119

[51] Int. Cl.[4] ..... A63C 9/08

[52] U.S. Cl. ..... 280/628; 280/630

[58] Field of Search ..... 280/611, 623, 625–630, 280/633, 634

[56] References Cited

FOREIGN PATENT DOCUMENTS 1428880 12/1968 Fed. Rep. of Germany ..... 280/630

486893 4/1970 Switzerland ..... 28/629

*Primary Examiner*—Robert J. Spar

*Assistant Examiner*—Donald W. Underwood

*Attorney, Agent, or Firm*—Sandler & Greenblum

[57] ABSTRACT

A safety binding for use with a ski including holding, support and intermediate members, and an elastic system. The holding member is adapted to hold one end of a ski boot onto the ski, and the support member is adapted to be attached to the ski. The elastic system acts on the holding member to press the intermediate member against the support member. In addition, the holding and intermediate members are adapted to pivot together with respect to the support member against the bias of the elastic system with substantially no relative movement between the holding and intermediate members for release of the boot whenever the holding and intermediate members pivot with respect to the support member. Further, the intermediate member is spaced from the support member during pivoting of the intermediate member.

2 Claims, 12 Drawing Figures

FIG. 4.
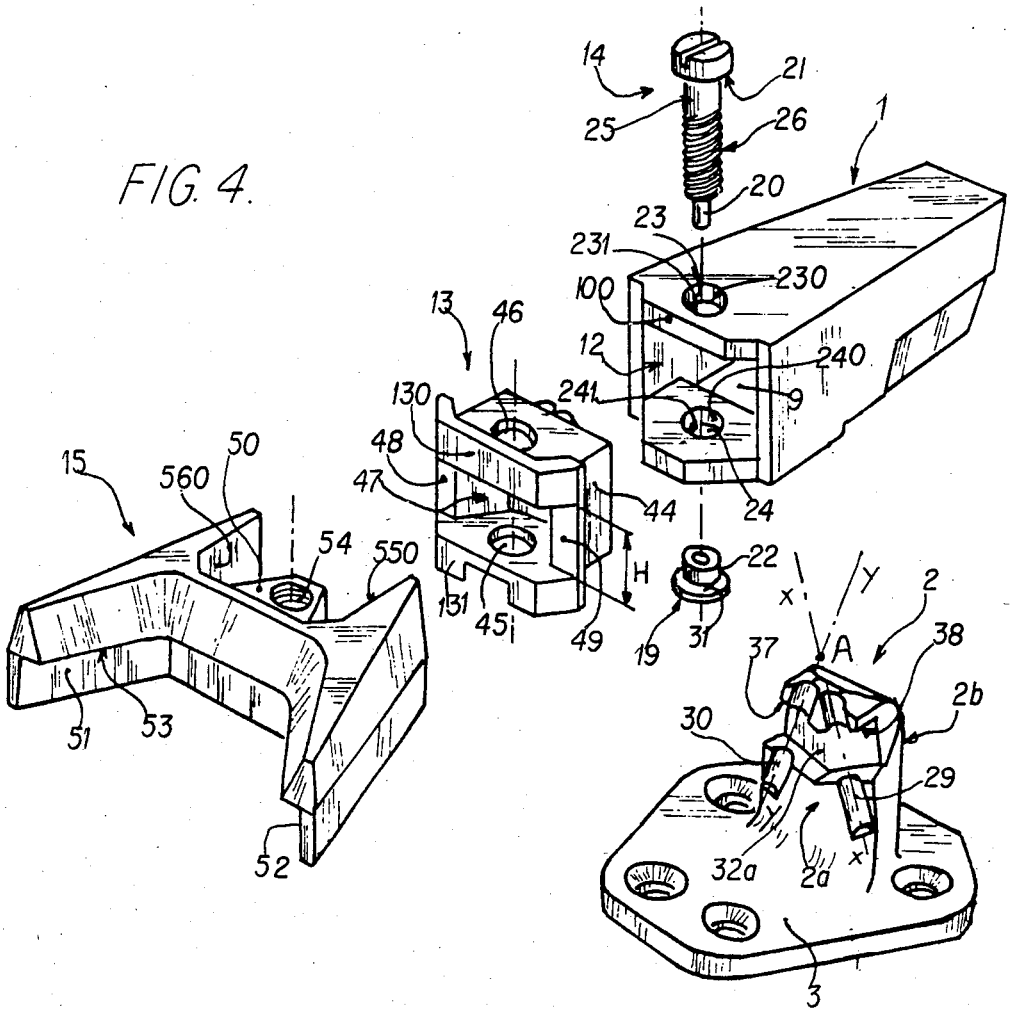
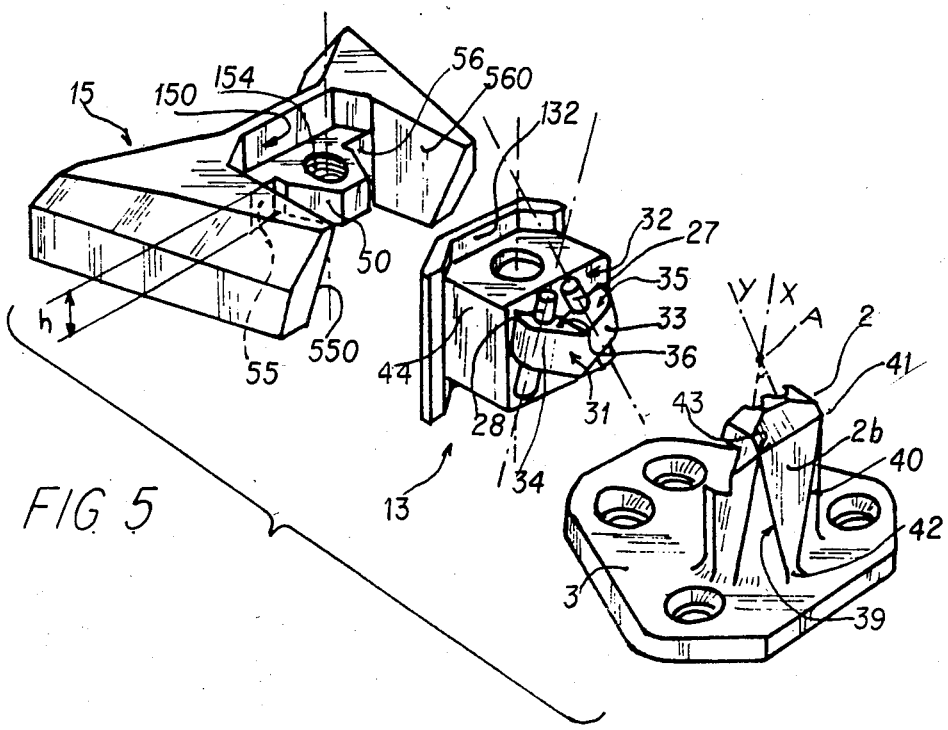
FIG 5

SAFETY BINDING FOR SKI

This is a continuation of application Ser. No. 376,754 filed May 10, 1982, now U.S. Pat. No. 4,457,533, which is, in turn, a continuation application of Ser. No. 106,148, filed Dec. 21, 1979 (now abandoned).

BACKGROUND OF THE INVENTION

The present invention relates to a safety binding for ski, intended for holding one of the ends of a boot, whilst the other end of the boot is held by a binding of conventional type, known per se, particularly a heel member.

The present invention relates more particularly to bindings in which the jaw is applied directly or indirectly on a support member fixed to the ski extending substantially perpendicularly thereto, and advantageously comprising two lateral lines of support disposed respectively on either side of the longitudinal plane of symmetry of the ski, so that the jaw may sometimes pivot on one of the lines of support, and sometimes on the other against the action of the elastic system.

SUMMARY OF THE INVENTION

The present invention relates to improvements of the bindings of the above-mentioned type. To this end, this binding comprising a holding member intended for holding one of the ends of the boot and a support member fixed to the ski and extending substantially vertically, is characterised in that it comprises an intermediate member held against the support member by the holding member subjected to the action of an elastic system, the holding member and the intermediate member forming an unit to pivot with respect to the support member against the action of the elastic system to allow the boot to be released. The elastic system advantageously comprises a movable member, acted on by a spring and abuts on the one hand on the front face of the support member, and on the other hand on an energisation member associated with the holding member by a connecting member.

According to a preferred embodiment, the energisation member is a body or box rigidly locked in displacement with the holding member and the intermediate member and contains the the elastic system, this body further presenting a downwardly open housing in which the support member extends, the connecting member being a screw used for adjusting the height of the holding member.

According to the invention, the holding member is applied by the elastic system against the intermediate member. To this end, the intermediate member comprises at least two zones of support for the holding member, these two zones of support being disposed on either side of the longitudinal plane of symmetry. With such arrangement, the holding member forms an unit with the intermediate member and the body or box, to form a whole which is rigidly locked in displacement. The boot is released by pivoting with respect to the support member which conprises two lines of support disposed on either side of the longitudinal plane of symmetry of the ski. There is therefore swivelling of the whole, sometimes on one of the lines of support, sometimes on the other. Such a construction makes it possible in particular to adjust the jaw in height without there being any clearance. In fact, the jaw is applied against the intermediate member due to the action of the elastic release system.

The binding according to the invention offers the advantage that all the constructional clearances are compensated, by successive supports of the members under the action of the elastic energisation system.

BRIEF DESCRIPTION OF DRAWINGS

The invention will be more readily understood on reading the following description with reference to the accompanying drawings, in which:

FIG. 4 is an exploded view in perspective showing more particularly the members seen from the rear to the front.

FIG. 5 is also an exploded view in perspective showing more particularly some of the members seen from the front to the rear.

DESCRIPTION OF PREFERRED EMBODIMENT

Figure 1:
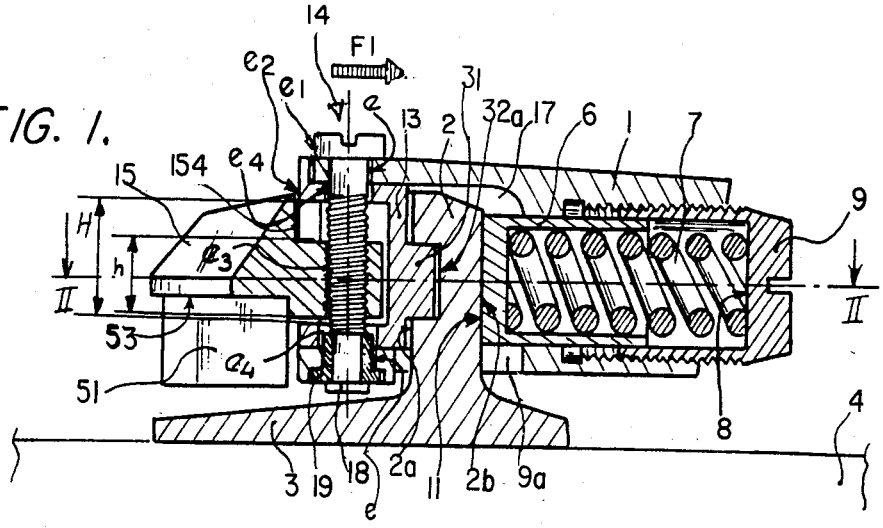
FIG. 1 is a view of the binding in vertical and axial section.

The safety binding according to the invention constitutes an abutment for the front of a ski boot. It should be noted that it could also hold the rear part of the boot without departing from the scope of the invention. Said binding mainly comprises an energisation member forming the body or box 1 of the binding. The body is held elastically in centred position due to an elastic system constituted by a sliding piston 6, acted on by a spring 7 which extends axially inside the body 1 and which abuts furthermore, at its front end, on the bottom 8 of an adjusting plug 9. The piston 6 is mounted to slide in a bore 10 disposed in the front part of the body 1, along the longitudinal axis, and which extends by a threaded part 16 in which the plug 9 is screwed. The piston is preferably constituted by a cylindrical bushing of revolution comprising a rear support face 11. The body 1 comprises a central recess 17 downwardly open at 9*a*. A support member 2 takes its place in this recess. The dimensions of the recess 17 are such that the swivelling of the body 1 with respect to the support member is possible on both sides. The support member 2 is fast with a base plate 3 fixed to the ski by screws 5. The body 1, on the other hand, comprises a rearwardly directed opening 12. This opening 12 is substantially parallelepipedic and serves as housing for an intermediate support member 13. A jaw 15 serving to hold the sole of a ski boot, the intermediate support member 13 and the energisation member or body 1 are connected together by a connecting member 14 serving, further, as height adjustment screw. This adjusting screw 14 is free to rotate and locked in translation with respect to the body due to a riveting 18 made on a bushing 19 in which the lower cylindrical part 20 of said screw 14 takes its place. The screw 14 is therefore free to rotate by cooperation of a cylindrical part 25 of the screw, located beneath its head, with an upper hole 23 and by cooperation of a part 22 of the bushing 19 with a lower shouldered hole 24, the upper and lower holes 23 and 24 being respectively disposed above and below the opening 12. The screw is maintained in translation due to a shoulder 21 of the screw on the one hand and a shoulder 31 of the bushing 19 on the other hand. The screw 14 comprises, inter alia, a threaded adjusting part 26.

The jaw 15, the intermediate member 13 and the energisation member form a one-piece assembly, elastically mobile with respect to the support member 2. The functioning of this assembly is of the swivelling type which has already been described in French Patent Applications Nos. 78 07805 and 78 08342. It will be recalled that the assembly is applied against the support member 2 under the action of the elastic system, along two lateral lines of support XX' and YY', disposed respectively on either side of the plane of symmetry of the ski, so that the assembly sometimes pivots on one of the lines of support, and sometmes on the other. These lines of support are materialised by projecting parts 27 and 28 on the intermediate member 13 cooperating with recessed parts 29 and 30, made in the rear face **2*a* of the support member 2. It is to be noted that one would not depart from the scope of the invention if the recessed parts were disposed on the intermediate member 13 and the projecting parts on the support member 2. The intermediate member 13 is applied against the support member 2 by action of the face 11 of the piston 6 against the front face 11 of the piston 6 against the front face 2*b* of the support member 2**.

The projecting parts 27 and 28 of the intermediate member 13 are forwardly projecting cylindrical profiles and therefore constitute ribs which, seen along the axis of the ski, converge towards each other at a point A located above the ski. According to an advantageous disposition, the two axes of the projecting profiles are in the same plane and therefore converging. When the assembly (1-13-15-14) is in rest position, the two ribs 27 and 28 take their place in two corresponding recessed grooves or profiles 29 and 30, provided in the rear face **2*a* of the support member 2, and which also converge towards a point located above the ski. The two ribs 27 and 28, engaged in this way in the two grooves 29 and 30**, thus define two convergent lines of support XX' and YY'.

The assembly is held vertically with respect to the fixed support member 2 by means of a projection 31 which extends forwardly from the front face 32 of the intermediate member 13 and which is engaged in a corresponding housing **32*a* made in the rear face 2*a* of the support member 2. As may be seen in FIG. 5, the projection 31 in fact comprises two corresponding projecting profiles 33 and 34 extending perpendicularly to the ribs 27 and 28, i.e. to the lines of support YY' and XX'. The projections 33 and 34 respectively define upper holding edges 35 and 36 which are substantially perpendicular to the lines of support YY' and XX'. The recessed part 32*a* of the support member 2 and with which the projection 31 cooperates, defines two upper edges 37 and 38 for vertical holding, the edge 37 being substantially perpendicular to the line of support YY', and the edge 38** being substantially perpendicular to the other line of support XX'.

According to an advantageous arrangement, the front face **2*b* is flat and included in a plane parallel to the transverse plane defined by the lines of support XX' and YY'. This support face has the form of an isosceles triangle with downwardly directed vertex (FIG. 5), and of which the angles are indicated by 41-42-43. The edge 39 is parallel to the line of support YY' and the other 40** is parallel to the line of support XX'.

Figure 3:
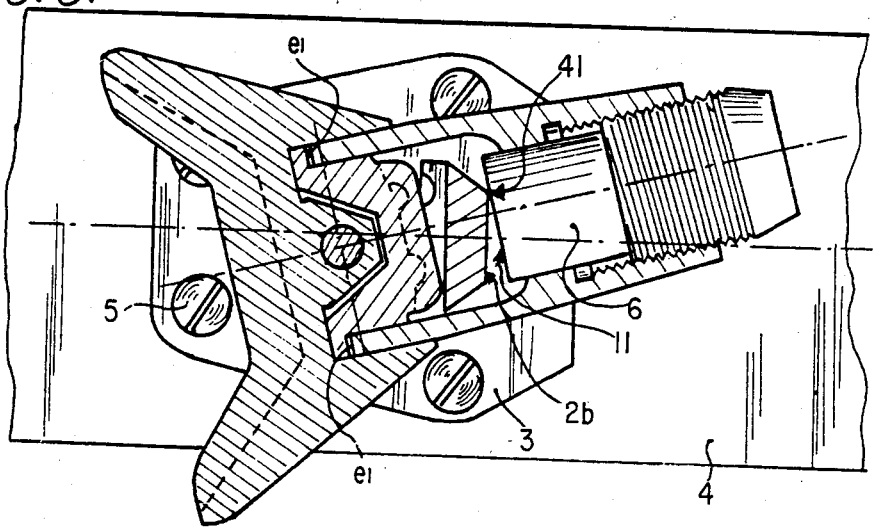
FIG. 3 is a view in horizontal section similar to that of FIG. 2, the binding being in the process of lateral release.

In the case of a lateral release, the assembly sometimes pivots on one of the lines of support XX', and sometimes on the other YY', according to the direction of release. This pivoting is effected elastically against the action of the elastic system acting by action of the piston 6 against the front face **2*b*. FIG. 3 shows a release towards the right. The assembly pivots about the line of support XX' and the face 11 of the piston 6 acts against the front face 2*b* of the support 2 along the line of action 41**.

The intermediate member 13 comprises, at the front, a hollow fitting part 44 whose dimensions enable it to be placed in the corresponding housing 12 of the body 1. Said part 44 comprises, as was seen previously, the projecting parts 27, 28 and 31 and, furthermore, two holes 45 and 46. The hole 46, made in the upper face of the member 13, is intended for the passage of the upper part 25 of the screw 14, and the hole 45, made in the lower face of the member 13, is intended for the passage of the part 22 of the bushing 19. The member 13 further comprises a rearwardly open recessed part 47 for receiving a forwardly projecting part 50 of the jaw 15. Two rear support faces 48 and 49, which are vertical and lateral, are provided on the member 13 on either side of the recess 47, for the jaw 15. The jaw 15 is intended to hold the front of the boot. The lateral holding of the boot is effected due to substantially vertical faces 51 and 52 and the vertical holding due to a horizontal edge 53 of the jaw. The projecting part 50 is pierced with a vertical threaded hole 54 adapted to receive the threaded part 26 of the screw 14. On the other hand, the front face of the jaw 15 comprises two lateral support surfaces 55 and 56 (located on either side of the projection 50) (FIG. 5) cooperating with the rear support faces 49 and 48 of the intermediate piece 13 (FIG. 4) by action of the elastic system 6 and 7. The faces 48, 49 and 55, 56 being transverse planes, the lateral holding of the jaw is ensured by lateral flanks 550 and 560 of this jaw, between which flanks the rear part of the body 1 is fitted.

As will be seen hereinafter in FIGS. 6, 7 and 8, the cooperation between the jaw and the intermediate member may be effected in different ways, the cooperation then being effected by projections engaged in recesses thus ensuring the lateral holding of the jaw without the aid of the flanks 550 and 560.

In FIG. 1, it is ascertained that the action of the piston 6 on the front face **2*b* of the support member 2 provokes a forward traction in the direction of arrow F1 of the body 1 with the connecting member 14. This therefore also provokes the forward traction in the direction of arrow F1 of the jaw 15 via the connecting member or screw 14. The jaw 15 is therefore applied against the intermediate member 13, the faces 55 and 56 of the jaw 15 (FIG. 5) being in abutment against the faces 49 and 48 of the intermediate member (FIG. 4), this intermediate member 13 itself being in abutment on the support member 2 along the lines of support XX' and YY'. The intermediate member 13 is consequently gripped between the jaw 15 and the support member 2** under the action of the elastic release system. The constructional clearances are thus compensated by successive supports of the members under the action of the elastic energisation system.

Figure 2:
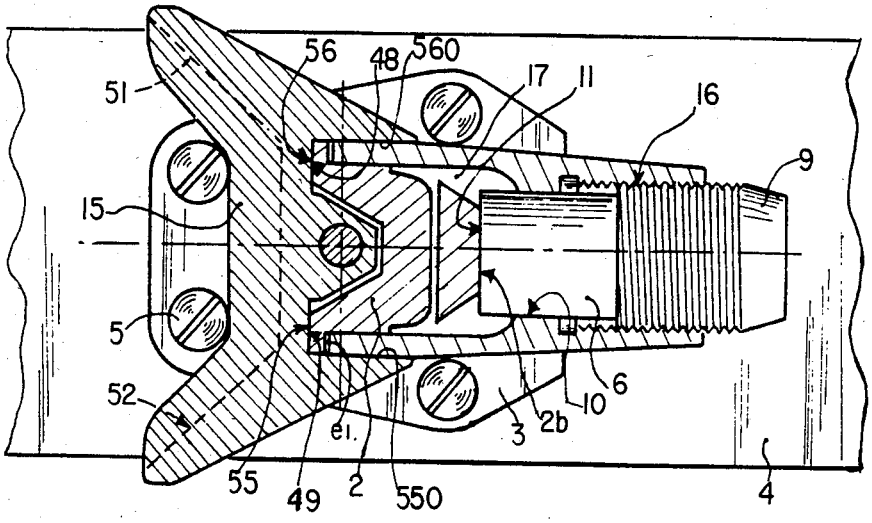
FIG. 2 is a view in horizontal section along II—II of FIG. 1.

It is therefore observed (FIGS. 1-2-3) that there is clearance at e, $e_1$, $e_2$, $e_3$ without the jaw 15 having clearance; e is the clearance between the connecting member 14 and the holes 23 and 24 of the body 1. It should be noted that the screw 14 is in contact with the rear part 231 (FIG. 4) of the hole 23 and that the clearance e is therefore at the front at 230 (FIG. 4). Similarly, the bushing 19 is in contact with the rear part 241 of the hole 24 and the clearance e of this bushing is at the front at 240.

$e_1$ is the longitudinal clearance between the intermediate member 13 and the body 1 and particularly, between the rear surface 100 (FIG. 4) of the body 1 and the opposite front surface 132 (FIG. 5) of the intermediate member 13.

$e_2$ is the clearance between the front transverse surfaces 154 (FIG. 5) of the jaw, located respectively above and below the projection 50, and the rear transverse surfaces 130 and 131 (FIG. 4) of the intermediate member, located respectively above and below the opening 47.

$e_3$ is the possible clearance between the treaded part 26 of the connecting screw 14 and the thread 54 of the jaw 15. It is thus ascertained that the screw is acted on by the elastic system in the threaded part of the jaw. There is therefore friction, this limiting the possibilities of untimely misadjustment.

$e_4$ is the clearance between the connecting screw 14 and the holes 45 and 46 of the intermediate member 13, this clearance being distributed all around said connecting screw.

With such a disposition, this occurs as if the jaw were directly applied on the support member under the action of the release system. In fact, the jaw 15 is pulled in the direction F1 against the intermediate member 13 which is therefore applied against the support member.

The connecting member 14 serves a screw for adjusting the jaw in height. To this end, the threaded part 26 of the screw 14 cooperates with the thread 54 made in the forwardly projecting part 50 of the jaw. It will be recalled that the screw is free to rotate and is locked in translation with respect to the body. It will be noted that, to allow the vertical displacement of the jaw, the thickness h (FIG. 1) of the projection 50 is smaller than the height H (FIG. 1) of the housing 47, the possibility of adjustment in height being H-h. When the screw is rotated, the jaw moves vertically and there is also displacement of the faces 55 and 56 against the respective support faces 48 and 49. It will be also noted that the height of the faces 55 and 56 is h (FIG. 5) and that the height of the corresponding support faces 48 and 49 is H (FIG. 4).

Figure 6:
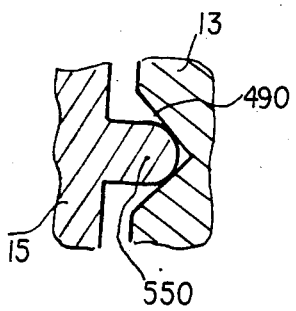
FIGS. 6, 7 and 8 are views in part section, on a large scale, of three variant embodiments of the mode of support.
Figure 7:
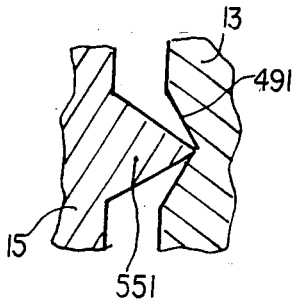

FIGS. 6, 7 and show variant embodiments of the lines of support XX' and YY', but these variants could also be used for the flat support faces 55 on 49 and 56 on 48 corresponding to the support of the jaw 15 on the intermediate member 13. It will be noted that these support faces are parallel and allow a vertical displacement of the jaw 15 with respect to the intermediate member 13 whilst ensuring a lateral holding.

FIG. 6 shows the jaw 15 which comprises a forwardly projecting cylindrical rib 550 and the support member 13 which has a recessed profile 490 in the form of a rearwardly open V.

In FIG. 7, the jaw 15 comprises a V shaped rib 551 cooperating with a recessed profile 491, also in the form of a V, in the member 13.

Figure 8:
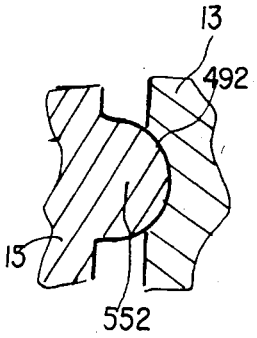

In FIG. 8, the jaw 15 comprises a cylindrical rib 552 cooperating with a cylindrical recessed profile 492 in the member 13.

Figure 9:
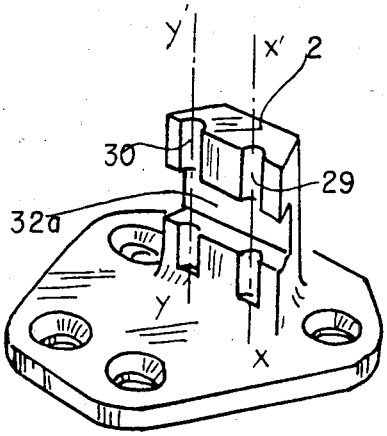
FIGS. 9 and 10 are views in perspective showing another possibility of producing the support member.
Figure 9A:
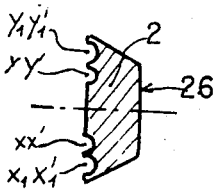
FIG. 9*a* is a view in section of another embodiment of the support member.
Figure 10:
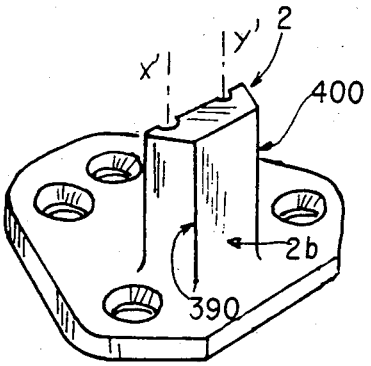

FIGS. 9 and 10 show a variant of the support member 2 and in which the recessed profiles 29 and 30 are disposed parallel to define two lines of support XX' and YY' which are parallel and perpendicular to the plane of the ski. The front face **2*b* of the support member 2 comprises a rectangular support face of which the actuating edges 390 and 400** are parallel to each other and parallel to the lines of support XX' and YY', i.e. perpendicular to the ski.

FIG. **9*a***, shows, in section, a variant of the lines of support. In fact, an outward lateral displacement of the supports in the process of release might also be provided. To this end, two supplementary recessed profiles $X_1X'_1$ and $Y_1Y'_1$, located downwardly outwardly with respect to the respective recessed profiles XX' and YY', might be added. It will be noted that $X_1X'_1$ may or may not be parallel to XX' and the same could apply to $Y_1Y'_1$.

Figure 11:
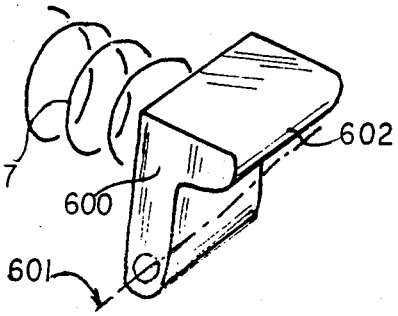
FIG. 11 is a view in perspective of a variant of the elastic system.

FIG. 11 shows another type of elastic system. In fact, without departing from the scope of the invention, the sliding piston 6 may be replaced by a pressure member constituted by a movable member 600 pivoted with respect to the body about a transverse axis 601. This movable member is acted on by the spring 7 and may comprise a projecting pressure zone 602 cooperating with the front face **2*b*** of the support member.

In the preferred embodiment, the jaw constitutes a one-piece assembly ensuring both the lateral and vertical holding of the boot but it may be otherwise, without departing from the scope of the invention. In fact, the lateral holding may be ensured due to lateral wings fast with the body 1 and only the element insuring the vertical holding could be vertically movable for adjustment in height.

One would not depart from the scope of the invention if the jaw were not one-piece, but comprised two parts pivoted about the connecting member and then being in reciprocal abutment one on the other. It will also be noted that the support member could also be in two parts, namely, for example, a front part fast with the ski and another part comprising the lines of support for the intermediate member.

In the preferred embodiment of the invention, the connecting member 14 is a screw for adjusting the height of the jaw, but it may be otherwise, without departing from the scope of the invention. In fact, the screw 14 could quite simply be a smooth pin, riveted in its lower part, the thickness h of the projecting part 50 of the jaw then being equal to H.

One or all the projections may naturally be replaced by recesses and, one or all the recesses are then replaced by projections, this disposition then being considered as solution equivalent to the embodiment proposed by way of example.

What is claimed is:

1. A safety binding for use with a ski, said binding comprising:

(a) a holding member adapted to hold one end of a ski boot onto said ski;

(b) a support member adapted to be attached to said ski;

(c) an elastic system; and (d) an intermediate member; said elastic system acting to press said intermediate member against said support member; said holding member and said intermediate member being cooperatively associated to pivot together with respect to said support member, against the bias of said elastic system, and wherein said intermediate member is spaced from said support member, with substantially no relative movement between said holding and intermediate members whenever said holding and intermediate members pivot with respect to said support member for release of said boot.

2. The binding of claim 1, wherein there is substantially no relative movement between said holding and intermediate members during release of said boot.

* * * * *